US007642492B2

(12) United States Patent
Parine et al.

(10) Patent No.: US 7,642,492 B2
(45) Date of Patent: Jan. 5, 2010

(54) SINGLE-AXIS FIN DEPLOYMENT SYSTEM

(75) Inventors: John C. Parine, Corona de Tucson, AZ (US); Jeffrey H. Koessler, Tucson, AZ (US); Purnachandra R. Gogineni, Tucson, AZ (US); Juan A. Perez, Tucson, AZ (US); Martin A. Kebschull, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 710 days.

(21) Appl. No.: 11/043,870

(22) Filed: Jan. 26, 2005

(65) Prior Publication Data

US 2006/0163423 A1 Jul. 27, 2006

(51) Int. Cl.
*F42B 10/14* (2006.01)

(52) U.S. Cl. ..... 244/3.27; 102/348; 244/3.28; 244/3.29

(58) Field of Classification Search ..... 244/3.29, 244/3.28, 3.27; 102/348, 400
See application file for complete search history.

(56) References Cited

U.S. PATENT DOCUMENTS

| | | | | |
|---|---|---|---|---|
| 2,271,280 A | | 1/1942 | Weinert | |
| 2,923,241 A | * | 2/1960 | House | 244/3.29 |
| 2,977,880 A | * | 4/1961 | Kershner | 244/3.29 |
| 3,063,375 A | * | 11/1962 | Hawley et al. | 244/3.27 |
| 3,093,075 A | * | 6/1963 | Garrett et al. | 244/3.24 |
| 3,127,838 A | * | 4/1964 | Francesco et al. | 244/3.27 |
| 3,643,599 A | * | 2/1972 | Hubich | 102/388 |
| 3,684,214 A | | 8/1972 | Kloss | |
| 4,523,728 A | * | 6/1985 | Frazer | 244/3.29 |
| 4,644,845 A | | 2/1987 | Garehime, Jr. | |
| 4,659,036 A | | 4/1987 | Pinson | |
| 4,664,339 A | | 5/1987 | Crossfield et al. | |
| 4,667,899 A | | 5/1987 | Wedertz | |

(Continued)

FOREIGN PATENT DOCUMENTS

| | | |
|---|---|---|
| FR | 1303729 | 9/1962 |

(Continued)

OTHER PUBLICATIONS

International Search Report from corresponding International Application No. PCT/US2006/002424.

*Primary Examiner*—Michael Carone
*Assistant Examiner*—Benjamin P Lee
(74) *Attorney, Agent, or Firm*—Renner, Otto, Boisselle & Sklar, LLP

(57) ABSTRACT

A missile has fins that rotate about a single axis to deploy from a stowed position to a deployed position. A foil longitudinal axis of each fin is angled relative to a shaft of the fin, such that a single-axis rotation of the shaft moves the foil from the stowed position to a deployed position. A coil spring may provide both torsion and compression forces to rotate the fin into the deployed position and lock it into place. Torsion rotates the shaft until it reaches a seat on a bushing that is around the shaft. Then compression forces from the spring engage a keyed protrusion on the shaft with a corresponding keyway in the bushing, locking the shaft in place. There may be an additional lock once the fin is deployed, such as a spring-loaded pin in the missile body that engages a depression in the shaft.

20 Claims, 5 Drawing Sheets

U.S. PATENT DOCUMENTS

| | | | | |
|---|---|---|---|---|
| 4,691,880 | A * | 9/1987 | Frank | 244/49 |
| 4,869,442 | A | 9/1989 | Miller | |
| 5,114,095 | A | 5/1992 | Schroppel et al. | |
| 5,464,173 | A * | 11/1995 | Sharrow et al. | 244/3.3 |
| 5,480,111 | A * | 1/1996 | Smith et al. | 244/3.27 |
| 5,762,294 | A | 6/1998 | Jimmerson | |
| 5,820,072 | A * | 10/1998 | Na et al. | 244/49 |
| 6,092,264 | A * | 7/2000 | Banks | 16/321 |
| 6,186,442 | B1 | 2/2001 | Bittle | |
| 6,224,013 | B1 | 5/2001 | Chisolm | |
| 6,315,240 | B1 * | 11/2001 | Rasmussen et al. | 244/3.24 |
| 6,446,906 | B1 * | 9/2002 | Voigt et al. | 244/3.27 |
| 6,454,205 | B2 | 9/2002 | Niemeyer et al. | |
| 6,761,331 | B2 * | 7/2004 | Eisentraut et al. | 244/3.28 |
| 6,905,093 | B2 * | 6/2005 | Dryer et al. | 244/3.28 |
| 7,004,424 | B1 * | 2/2006 | Pacchia | 244/3.27 |
| 7,059,561 | B2 * | 6/2006 | Trouillot | 244/3.28 |
| 2004/0144888 | A1 * | 7/2004 | Dryer et al. | 244/3.27 |
| 2005/0211827 | A1 * | 9/2005 | Barocela | 244/46 |
| 2005/0218260 | A1 * | 10/2005 | Corder et al. | 244/49 |

FOREIGN PATENT DOCUMENTS

| | | |
|---|---|---|
| FR | 1485580 | 6/1967 |
| FR | 1505851 | 12/1967 |
| WO | WO 88/05898 | 8/1988 |

* cited by examiner

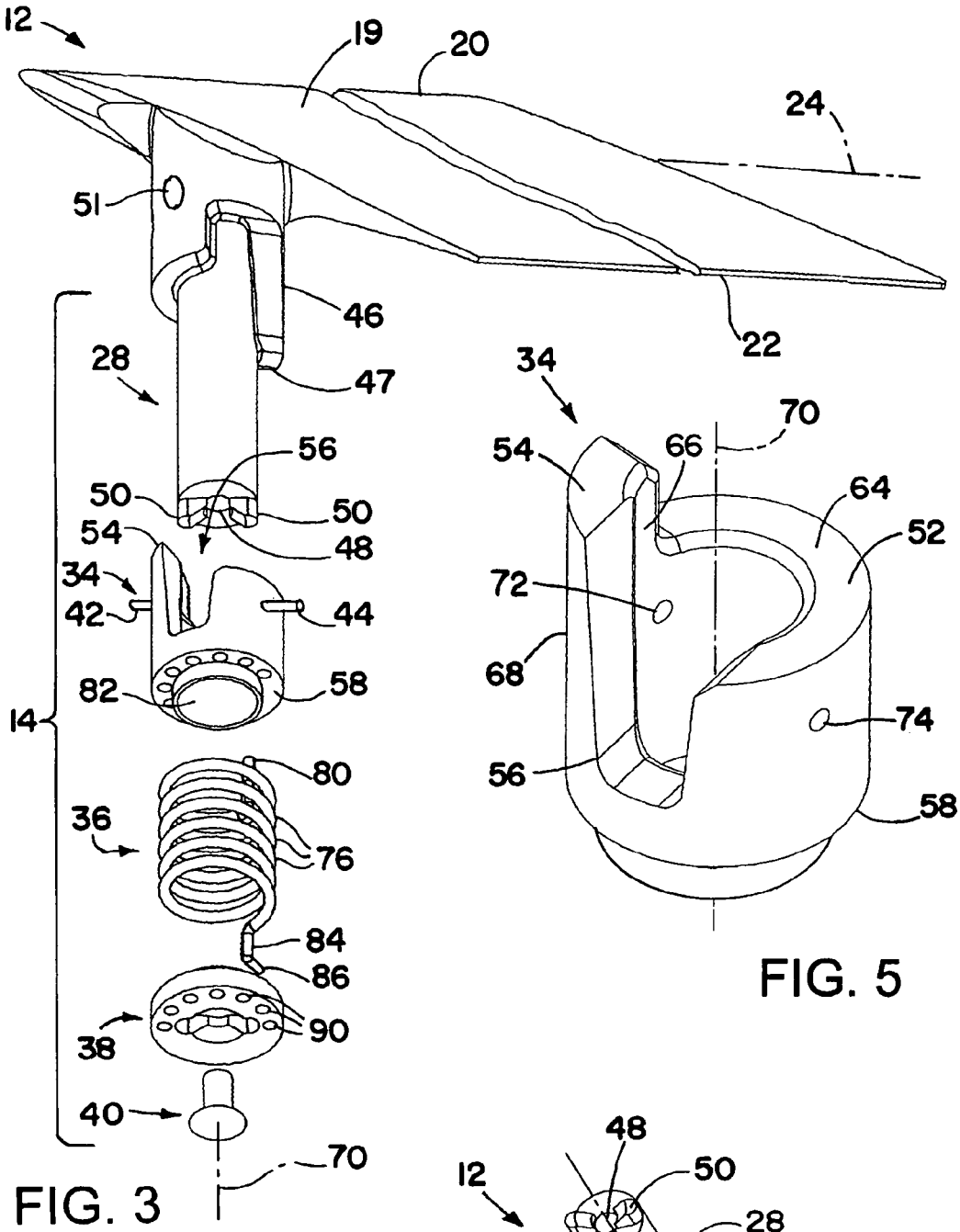
FIG. 3
FIG. 5
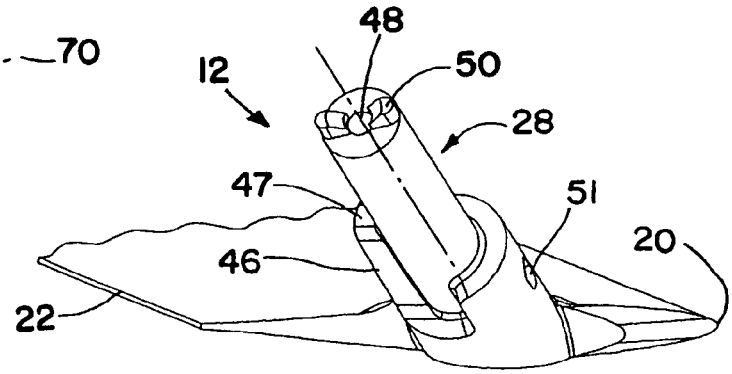
FIG. 4

SINGLE-AXIS FIN DEPLOYMENT SYSTEM

FIELD OF THE INVENTION

The present invention generally relates to vehicles having stowable fins, and, more particularly, to a system for stowing and deploying the fins.

BACKGROUND OF THE INVENTION

Many types of vehicles utilize two or more protruding surfaces to affect the fluid flow around the vehicle, thereby facilitating control of its flight path. Exemplary types of such vehicles include aircraft, airships, unmanned aerial vehicles, and various types of ordnance, e.g., missiles, rockets, guided projectiles, bombs, torpedoes and the like.

For example, missiles generally have a cylindrical body, with at least two aerodynamic surfaces or fins that extend outwardly from the sides of the missile body (vehicle housing) to affect the aerodynamic characteristics of the missile in flight. The fins typically have an airfoil shape that is oriented edge-on or slightly inclined relative to the airflow when the missile is flying in a straight line. These fins may be, for example, static (fixed) or dynamic (selectively movable, i.e., controllable). Fixed fins generally are used to stabilize the missile during flight and do not move once fully deployed. Controllable fins (control fins) are used to control or steer the missile by selectively varying the attitude of the fins relative to the airflow under the direction of the missile's control system.

In many cases, the fins are stowed in a position adjacent to the outside surface or within the missile body during storage and mounting on a vehicle prior to use. In some cases, the missile is stored in a tube, a canister or other protective casing, and the protective casing also may serve as a launch tube. The fins are stowed in such a manner as to permit more missiles to be stored and/or transported in a limited space. Stowing fins in such a manner also reduces the likelihood of damage to the fins during storage and handling. Additionally, such stowing maximizes subsystem packaging volume inside the vehicle housing for various components, e.g., electronic components, propulsion systems, warheads and the like.

The fins are deployed from the stowed position shortly after deployment of the missile, or during the launch phase of the missile. Various relatively complex deployment systems have been developed to permit the fins to be stowed, deployed and locked into place. Control fins may further be moved (usually only rotated) by an actuator system once the control fins are deployed.

In some cases, the fins are stowed by folding the fins like jack knifes or sling foils into the body of the vehicle through longitudinal slots in the vehicle's housing. Complicated retention features and housings are provided to retain the fins in the vehicle housing until the vehicle clears the weapon system, e.g., a bomb bay, a launch rail, a bore of a weapon system, e.g., a cannon, a gun, a howitzer, a mortar tube, a canister or the like. For example, covers are employed to seal the longitudinal slots and retain the fins until needed in flight. In some cases, multiple mechanisms are used, for example, a cover deployment system is provided to effectively discard the covers and a fin deployment system is provided to deploy the fins in flight.

Many fin deployment systems require the fins to deploy about more than one axis. That is, fin deployment systems require a fin to pivot or rotate about a first axis and then to pivot or rotate about a second axis in order to transition from a stowed configuration to a deployed configuration. In some cases, the fins transition to an intermediate configuration before transitioning to a final deployed configuration.

The systems presently used to retain, deploy, lock into place and control (if applicable) the fins tend to be relatively heavy, complex and expensive to design, build and maintain. Moreover, some systems occupy a relatively large volume within the missile, a significant disadvantage because of the limited space within the missile.

SUMMARY OF THE INVENTION

There is a need for a simple and reliable system to stow stowable vehicle fins in a stowed configuration, deploy the fins about a single axis, and retain or lock the stowable vehicle fins into a deployed configuration and, in some cases, control the fins in the deployed configuration. The present invention provides a deployment system for stowing and deploying stowable fins that meets this need and provides further advantages in cost, weight and space savings. Additionally, the present invention allows for smaller vehicles with increased capability and performance.

More particularly, the present invention provides a vehicle with a deployment system that automatically deploys a fin from a stowed orientation to a deployed orientation as soon as the fin is released. The deployment system includes a spring that provides a biasing force that urges the fin to move quickly, simply and reliably from the stowed orientation to the deployed orientation about a single axis. The deployment system also includes one or more slots or other means for locking the fin in the deployed orientation.

An exemplary deployment system for the vehicle includes a bushing that can be mounted in a cylindrical cavity in the vehicle housing. The fin includes a foil that is connected to a shaft (and may be integral with the shaft) that extends through a through hole in the bushing. The shaft is connected to the bushing through a drive spring that biases the shaft to the deployed orientation. The shaft, the bushing and the spring thus cooperate to move the fin from the stowed orientation to the deployed orientation. The shaft controls or guides the fin as it is deployed.

Additionally, the drive spring will rotate and translate the fin as it is deployed and/or secure (lock) the fin from further rotation relative to the bushing in the deployed orientation. A blind slot or detent may be formed in the shaft to receive a locking mechanism that inhibits axial movement of the fin relative to the shaft in the deployed orientation. A shear pin or other retaining means may be provided to fixedly retain the bushing in the vehicle housing.

According to an aspect of the invention, a missile includes: a missile body; a deployable fin having a shaft inserted into a cavity in the missile body; and a torsion spring coupled to the shaft, wherein the spring is configured such that torsion from the spring rotates the fin about an axis of the shaft, thereby deploying the fin.

According to another aspect of the invention, a method of launching a missile, includes the steps of: placing the missile in a launch tube, wherein fins of the missile are in a stowed configuration, pressing against guide rails of the launch tube; accelerating the missile, wherein the fins continue to press against the guide rails of the launch tube while the missile is in launch tube; and after the missile exits the launch tube, deploying the fins by use of torsion and compression spring forces to effect single-axis rotation of each of the fins.

To the accomplishment of the foregoing and related ends, the invention provides the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale:

FIG. 3 is an exploded schematic perspective view of a fin and deployment system in accordance with the invention;

FIG. 4 is a bottom view of the fin of in FIG. 3;

FIG. 5 is a side view of a bushing in accordance with the invention;

DETAILED DESCRIPTION

A missile has fins that rotate about a single axis to deploy from a stowed position, in which a foil of the missile may be substantially parallel to a missile body, to a deployed position, in which the foil may be substantially perpendicular to the missile body. A foil longitudinal axis of each fin is angled relative to a shaft of the fin, such that a single-axis rotation of the shaft moves the wing or foil from the stowed position to a deployed position. A coil spring may provide both torsion and compression forces to rotate the fin into the deployed position and lock it into place. Torsion rotates the shaft until it reaches a seat on a bushing that is around the shaft. Then compression forces from the spring engage a keyed protrusion on the shaft with a corresponding keyway in the bushing, locking the shaft in place. There may be an additional lock once the fin is deployed, such as a spring-loaded pin in the missile body that engages a depression in the shaft.

Figure 1:
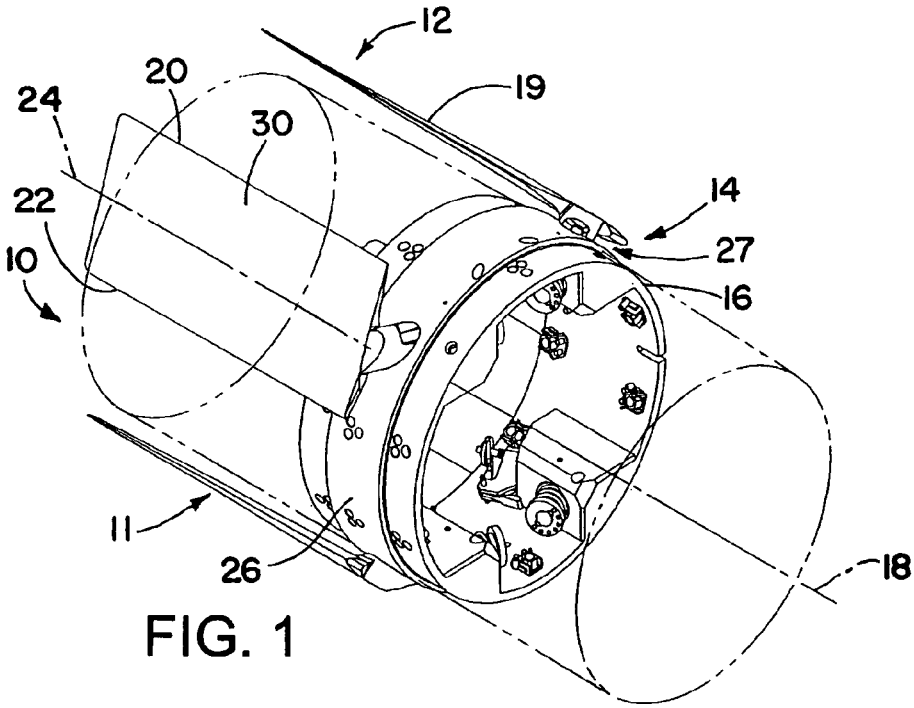
FIG. 1 is an oblique view of an exemplary vehicle housing section with aerodynamic fins in a stowed configuration.
Figure 2:
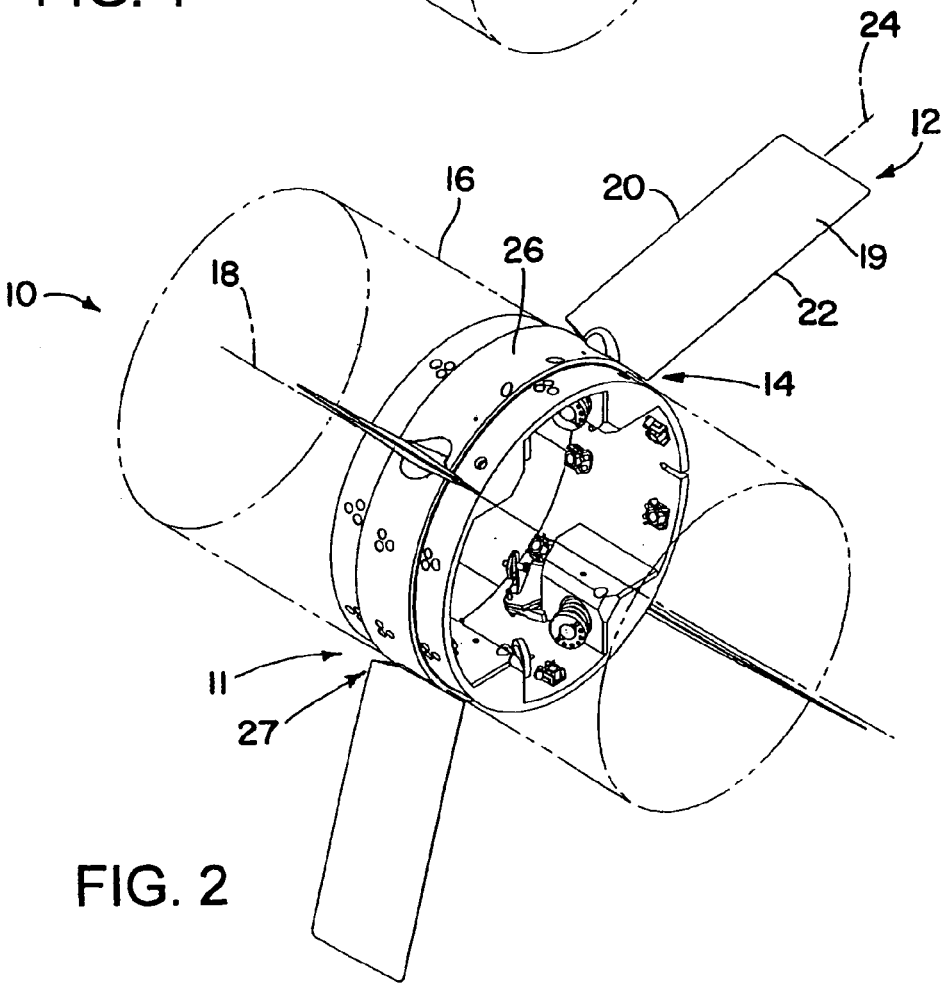
FIG. 2 is an oblique view of the vehicle housing section shown in FIG. 1, with the fins in a deployed configuration.

Referring now to the drawings, and initially to FIGS. 1 and 2, a missile or other vehicle 10 (only a part of the missile is shown) includes a fin module 11 that has a plurality of deployable fins 12 for sustaining, stabilizing or controlling the vehicle 10 during flight, and a deployment system 14 for simply, reliably and quickly deploying the fins 12 from a stowed configuration (FIG. 1) to a deployed configuration (FIG. 2). Having the fins 12 stowable allows the missile 10 to be launched in a more compact configuration, such as from a launch tube. Having the fins 12 be stowable externally to the missile 10 and deployable also may aid in reducing the storage volume of the missile 10. The illustrated vehicle 10 has four fins 12 mounted to a generally cylindrical body or housing 16 having a longitudinal axis 18. Although the vehicle 10 is referred to herein as a missile, the vehicle 10 may represent other types of vehicles that use stowable fins. Further, the vehicle 10 may alternatively have more or fewer fins 12 than as shown.

Each fin 12 has a foil 19 with a leading edge 20 and a trailing edge 22 that bound the chord of the foil 19, and a longitudinal axis 24 that extends approximately along the length of the foil 19. The leading edge 20 of the foil 19 faces in a forward direction generally toward the leading or forward end of the vehicle 10 during flight. The thickness of the foil 19 is less than its width or length, and the geometry of the foil 19 is selected for its intended application.

In the stowed configuration shown in FIG. 1, the foils 19 of the fins 12 lie adjacent to or near an outer surface 26 of the vehicle housing 16. The longitudinal axis 24 of each of the foils 19 may be substantially parallel to the longitudinal axis 18 of the vehicle housing 16. The leading edge 20 and the trailing edge 22 of each of the foils may also be substantially parallel to the missile body longitudinal axis 18, for example allowing the missile 10 to fit into a launch tube having an inner diameter slightly larger than the diameter of the body or housing 16. Alternatively, the foil axis 24 and the foil edges 20 and 22 may be angled relative to the missile body longitudinal axis 18.

The missile body 16 has cavities 27 for receiving respective shafts 28 of the fins 12. As will be described in greater detail below, rotation of the fin 12 about the axis of the shaft 28 moves the fin 12 from its stowed configuration (FIG. 1) to its deployed configuration (FIG. 2). Thus the shaft 28 is angled relative to the foil longitudinal axis 24. In the deployed configuration shown in FIG. 2, the foil 19 of each of the fins 12 may extend radially out from the outer surface 26 of the vehicle housing 16. Thus when the fins 12 are deployed, the foil longitudinal axis 24 is at an angle to, and may be substantially perpendicular to, the body longitudinal axis 18. The angle between the longitudinal axes 18 and 24 may be as small about 0 degrees, and make take any of a wide variety of values.

The movement of the foil 19 from the stowed configuration shown in FIG. 1 to the deployed configuration shown in FIG. 2 may be conceived of as two or more rotations, such as 1) a rotation of the foil 19 along or substantially parallel to the surface 26 of the missile body 16, to orient the leading edge 20 toward the front of the missile body 16 and the trailing edge 22 toward the back of the missile body; and 2) a rotation of the foil 19 so that it is substantially perpendicular to the surface 26 of the missile body 16. However, it will be appreciated that these multiple rotations are equivalent to a single rotation about an appropriately-placed axis. The shaft 28 is located relative to the foil longitudinal axis 24 such that a single-axis rotation of the fin 12 about the axis of the shaft 28 is sufficient to deploy the fin 12. Thus the shaft 28 is at a suitable angle relative to the foil longitudinal axis 24 to allow the single-axis deployment.

The fin 12 is connected to the vehicle housing 16 through the deployment system 14, which moves the fin 12 from the stowed orientation to the deployed orientation. The deployment system 14 is mounted at least partially in the cavities 27 in the vehicle housing 16 (FIGS. 1 and 2).

Turning now to FIG. 3, further details are shown of the deployment system 14 for deploying one of the fins 12. The deployment system 14 includes the shaft 28 of the fin 12, a bushing 34, a drive spring 36, a retainer 38, and a retainer pin 40. In short, the bushing 34 is fixedly connected to the missile body 16 by a pair of shear pins 42 and 44. The spring 36 is coupled to both the bushing 34 and the shaft 28, such that when the fin 12 is released, the spring 36 produces a torque on the shaft 28 that rotates the fin 12 about the shaft, relative to the missile body 16. This rotation moves the fin 12 from the stowed position to the deployed position. After the desired rotation is achieved, the shaft 28 reaches a seat on the bushing 34. Then the spring 36 extends, coupling together the shaft 28 and the bushing 34, locking the fin 12 in the deployed position.

With reference in addition to FIG. 4, the foil 19 and the shaft 28 are attached together, and may be portions of a single piece of material. The shaft 28 includes a keyed protrusion or key 46. The key 46 has a bottom surface 47 that slides along a surface of the bushing 34, as will be discussed further below. As will also be described further below, the key 46 is configured to fit into and an engage a recess in the bushing 34, to secure the fin 12 in its deployed position. At a base of the shaft 28, distal from the foil 19, is a partially or fully threaded bore 48 for securing the retainer pin 40 (retaining screw) therein. The retainer pin 40 is threaded into the bore 48 to secure the retainer 38 to the distal end of the shaft 28. Protrusions 50 on the end of the shaft 28 fit into corresponding recesses in the retainer 38, to aid in securing the shaft 28 to the retainer 38. The shaft 28 further includes a recess or detent 51 for receiving a pin, to assist in maintaining the fin 12 in its deployed position.

The shaft 28 may be manufactured to fit with a close tolerance against the inner diameter of the bushing 34. The bushing 34 is fixedly mechanically coupled to the missile body 16, and functions to protect the missile body 16, which may be made of a relatively soft material, such as aluminum. The bushing 34 thus may be made of a relatively hard material, such as steel.

With additional reference to FIG. 5, the bushing 34 has a pair of raised portions 52 and 54 on either side of a keyway 56. The keyway 56 is configured to receive the key 46 on the shaft 28 (FIG. 3), to couple the bushing 34 and the shaft 28 together, to thereby lock the fin 12 in its deployed position, preventing further rotation of the fin 12 relative to the bushing 34 (and the missile body 16).

On the opposite end from the keyway 56, the bushing 34 has an external step, ledge or shelf 58. The shelf 58 is formed by an abrupt decrease in the external diameter of the bushing 34. The shelf 58 is configured for engaging the drive spring 36, for example by having one or more holes therein.

The raised portion 52 of the bushing 34 has top surface 64 (FIG. 5) that engages the bottom surface 47 of the key 46 (FIG. 4). As part of the deployment of the fin 12, the bottom surface 47 of the key 46 slides along the top surface 64 as the shaft 28 rotates relative to the bushing 34. This rotation is effected by a torsion force produced by the spring 36, which results in a torque on the shaft 28. After the desired amount of rotation of the fin 12 has been achieved, the key 46 contacts a key seat 66 on a side surface of the raised portion 54. The raised portion 54 has a height that extends above the lower end of the top surface 64, and contact of the key seat 66 by the key 46 prevents further rotation of the fin 12. A spring force from the spring 36 then pushes the bushing 34 and the shaft together in a direction along a longitudinal axis 70 of the bushing 34. This causes the key 46 to enter into the keyway 56 and be secured between the raised portions 52 and 54. Thus further rotation of the shaft 28 in either direction is prevented.

The shear pins 42 and 44 (FIG. 3) are used to secure the bushing 34 in the cavity 27 (FIG. 1). The shear pins 42 and 44 engage corresponding recesses 72 and 74 in the bushing 34.

Figure 6:
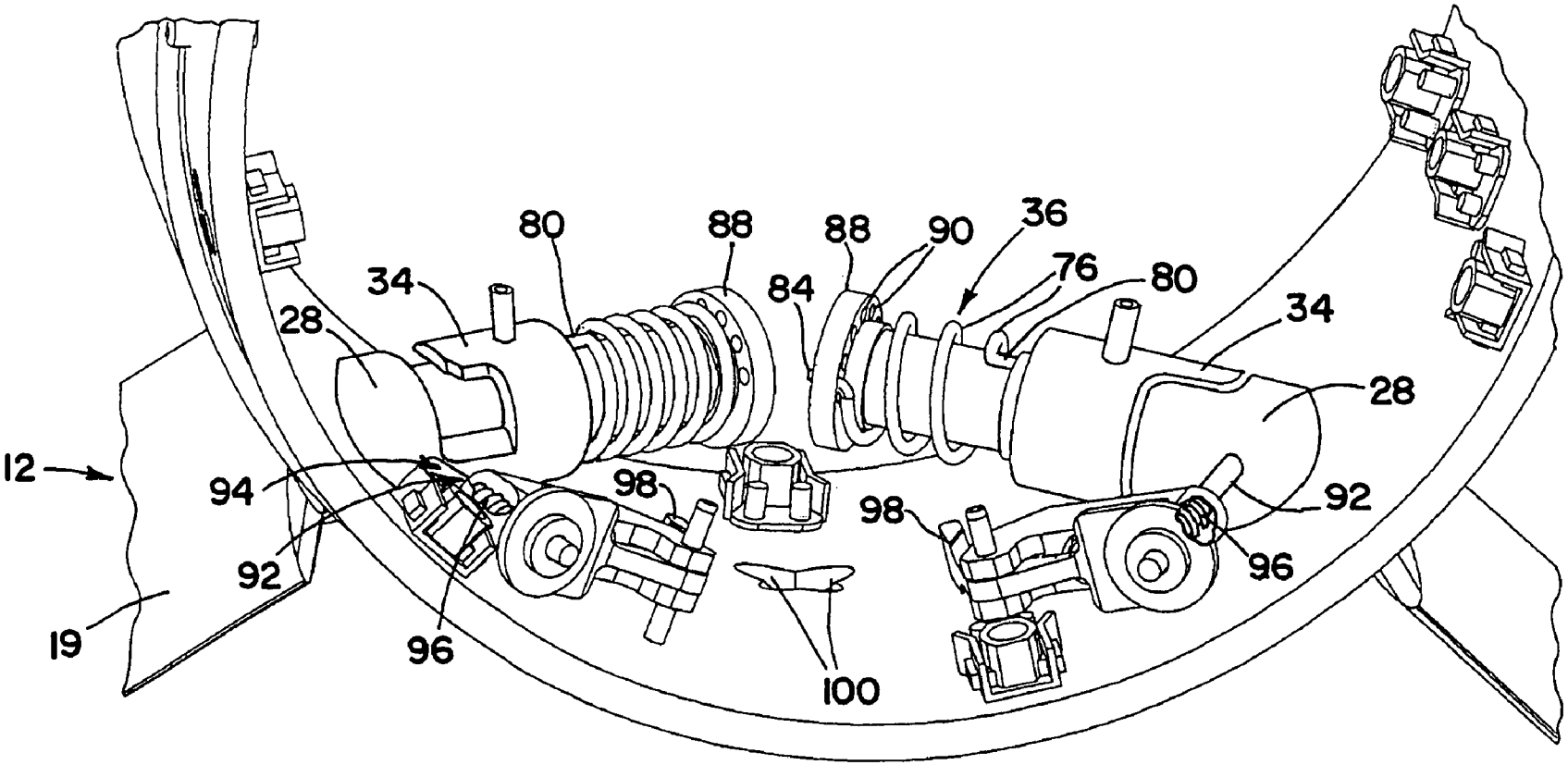
FIG. 6 is an oblique interior view of part of a missile in accordance with the present invention, showing a fin and deployment system in a stowed configuration (left hand side of FIG. 6) and a deployed configuration (right hand side of FIG. 6)

With reference now to FIG. 6, the drive spring 36 is a coil spring that has multiple coils 76, and that utilizes both torsion and compression forces for deploying the fin 12. At a first end, the drive spring 36 includes a first tab 80 that is placed into a hole 82 in the shelf 58 of the bushing 34, thereby securing one end of the coil spring 36 to the bushing 34. At the other end of the spring 36, a second tab 84 is placed in one of a series of holes 90 in a flange portion 88 of the retainer 38. Two or more holes 90 may be employed, with various locations to provide an increase or decrease in the biasing force stored by the drive spring 36. Thus, the second tab 84 may be inserted into various of the openings 90 to adjust the biasing force in the drive spring 36 to control the deployment of the fin 12. The use of openings 90 may also account for force differences associated with the manufacture of the drive spring 36.

The missile body 16 includes a locking mechanism 92 for further locking the fin 12 in place once it has reached its deployed position. The locking mechanism includes a spring-loaded locking pin 94 that is biased by a spring 96 to press against the shaft 28. Once the fin 12 has reached its deployed position, illustrated in the right hand side of FIG. 6, the locking pin 94 engages the recess or detent 51 in the shaft 28, the shaft 28 having rotated and translated in the deployment process to allow the pin 94 to engage the recess or detent 51. The locking mechanism 92 aids in keeping the fin 12 locked in the deployed position by preventing both rotation and axial translation of the shaft 28. The lock mechanism 92 also includes a release lever 98 to disengage the locking pin 94. As the release lever 98 is depressed, the locking pin 94 is moved away from the shaft 28, against the force of the spring 96. This allows the fin 12 to be returned to a stowed position from a deployed position, by then pulling the shaft 28 slightly outward (thereby disengaging the key 46 of the shaft 28 from the keyway 56 of the bushing 34), and rotating the fin 12 about the shaft 28. The release lever 98 may be depressed by inserting a push rod into an access hole 100 in the missile body 16.

Figure 7:
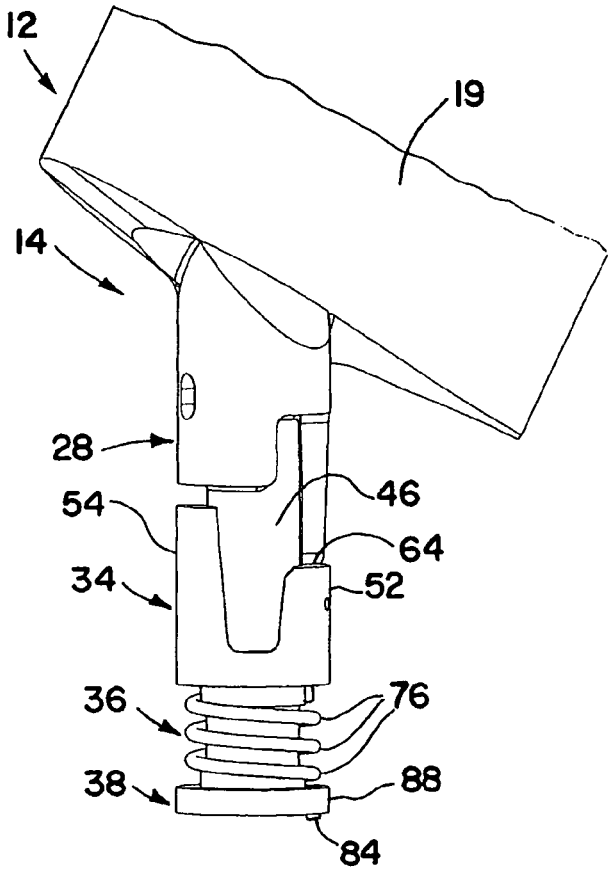
FIGS. 7, 8, and 9 are oblique views of the fin and the deployment system shown in FIG. 3, transitioning from the stowed configuration to the deployed configuration in accordance with the invention.
Figure 8:
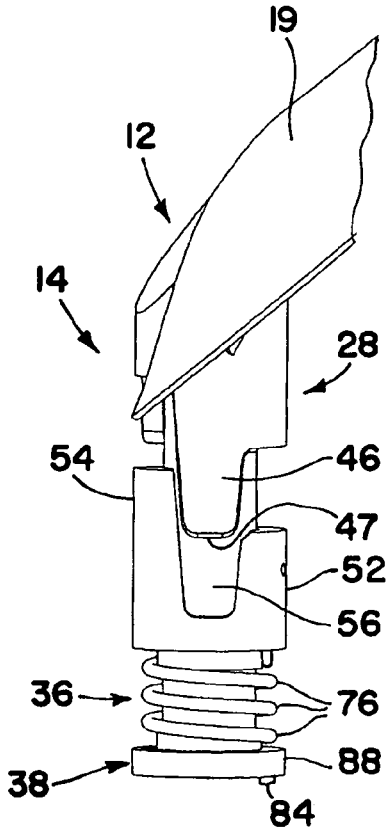
Figure 9:
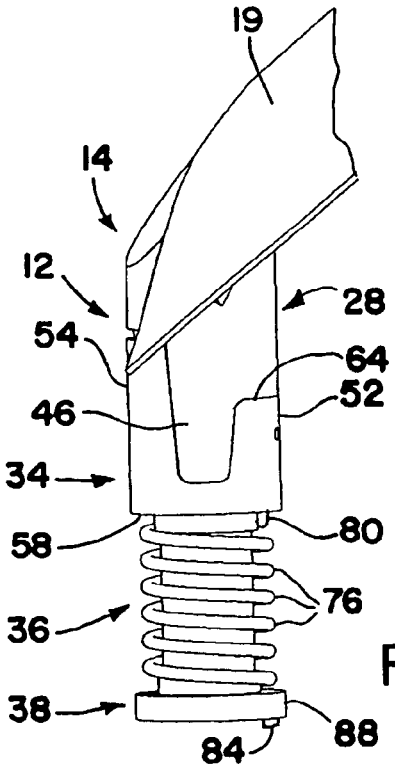

With reference to FIGS. 7-9, steps in the deployment process of the fin 12 are discussed. Before the missile 10 is loaded into a launcher such as a launch tube, the fins 12 may be held in a stowed configuration (FIG. 7) by a retainer, which may be removed as the missile 10 is inserted into the launch tube. Within the launch tube, the fins 12 are maintained in a stowed configuration by the sides of the launch tube. That is, the sides of the launch tube prevent the fins 12 from having enough room to deploy.

Once the missile 10 exits the launch tube, the fins 12 are no longer retained by the sides of the launch tube, and begin to deploy. With the fins 12 in the stowed configuration, the drive spring 36 stores energy both due to the compression of the spring 36 and torsion of the spring 36. The deployment is driven by the drive spring 36. One end of the spring 36 is fixedly coupled to the bushing 34, which in turn is fixedly connected to the missile body 16. However, the other end of the spring 36 is coupled to the retainer 38, which in turn is connected to the shaft 28 by the retainer pin 40. This end of the spring 36, along with the retainer 38 and the shaft 28, are free to turn relative to the bushing 34. Thus the shaft 28 begins to rotate on its axis, within the bushing 34, rotating the fin 12 toward its deployed position. During this rotation, illustrated in FIG. 8, compression forces of the spring 36 tend to push the retainer 38 away from the bushing 34 (and pull the foil 19 toward the bushing 34). Thus during the rotation the bottom surface 47 of the key 46 of the shaft 28 is in contact with the top surface 64 of the raised portion 52 of the bushing 34. It will be appreciated that the torsion force exerted by the spring 36 must be sufficient to overcome frictional forces of the bottom surface 47 of the key 46 bearing against the top surface 64 of the bushing 34. In addition, it will be appreciated that it is desirable to minimize frictional forces within the spring 36 during rotation. Accordingly, the spring may be configured such that none of the coils 76 of the spring 36 are in contact with one another, even when the spring is compressed.

Once the key 46 contacts the key seat 66, illustrated in FIG. 9, further rotation of the shaft 28 is prevented. Now the compressive forces of the spring 36 push the retainer 38 away from the bushing 34, thereby pulling the fin 12 inward toward the missile body 16. Specifically, the key 46 on the shaft 28 is pulled down into the keyway 56. This puts the key 46 between the raised portions 52 and 54, preventing rotation of the shaft 28 in either direction.

In addition, this further pulling down of the shaft 28 into the cavity 27 causes the recess or detent 51 to reach the location of the spring-loaded pin 94, which under the action of the spring 96 then engages the recess 51. This engagement of the lock mechanism 92 helps prevent rotations of the shaft 28, and in addition, prevents translation of the shaft 28 along its axis.

It will be appreciated that the deployment of the fins 12 occurs spontaneous upon the exit of the missile 10 from its launch tube, without further actuation to start the deployment process. As an alternative, it will be appreciated that the deployment system 14 may be manually or automatically activated.

Figure 10:
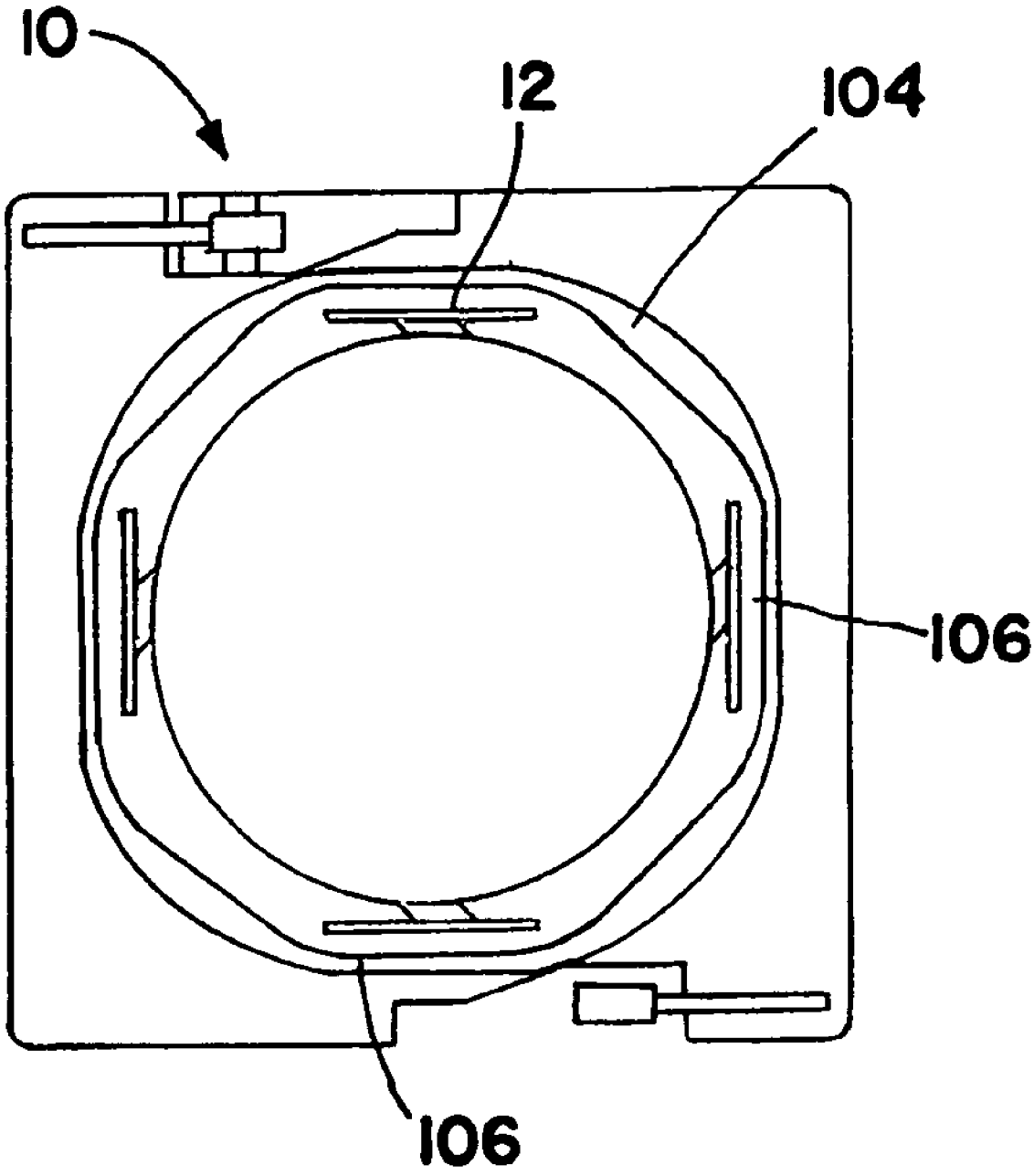
FIG. 10 is a top view of a vehicle with the deployment system of the present invention including four fins of the vehicle in a stowed configuration in a canister.

FIG. 10 shows a possible configuration of the missile 10 within a launch tube 104. During placement of the missile 10 in the launch tube 104, the fins 12 are assembled in or moved to the stowed. While the missile 10 is in the launch tube 104, the fins 12 are maintained in the stowed position by pressing against guide rails 106, which prevent deployment of the fins 12. During launch, the distal ends of the fins 12 engage the guide rails 106 of the launch tube 104 as the vehicle 10 moves down the launch tube 104.

The invention thus provides a simple and reliable mechanism to both hold the fins in a stowed position and to release the fins to a deployed configuration. Further, no parts of the device are shed or broken away upon deployment of the fins, thereby minimizing or eliminating the risk of injury to the launch vehicle or operator.

Although the invention has been shown and described with respect to certain preferred embodiments, it is obvious that equivalent alterations and modifications will occur to others skilled in the art upon the reading and understanding of this specification and the annexed drawings. In particular regard to the various functions performed by the above described components (assemblies, devices, sensors, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application.

What is claimed is:

1. A missile comprising:

a missile body;

a deployable fin having a shaft inserted into a cavity in the missile body; and a torsion spring coupled to the shaft, wherein the spring is configured such that torsion from the spring rotates the fin about an axis of the shaft to deploy the fin in a single step by a single-axis rotation about the axis of the shaft;

wherein the fin includes a foil coupled to the shaft;

wherein the foil and the shaft are fixedly attached together; and wherein the foil and the shaft are parts of a monolithic single piece of material.

2. The missile of claim 1, wherein the spring is a coil spring that also provides a force translating the shaft within the cavity.

3. The missile of claim 2, wherein the coil spring is around a portion of the shaft.

4. The missile of claim 2, wherein the coil spring includes plural coils none of which are in contact with each other.

5. The missile of claim 1, wherein the shaft passes through a bushing that is in the cavity and is fixedly attached to the missile body.

6. The missile of claim 5, wherein a first end of the spring is fixedly attached to the bushing.

7. The missile of claim 6, wherein a second end of the spring is coupled to the shaft.

8. The missile of claim 7, wherein the second end of the spring is fixedly attached to a retainer that is mechanically coupled to the shaft.

9. The missile of claim 8, wherein the retainer has plural holes therein, for receiving a tab at the second end of the spring; and wherein the holes allow the spring to be installed with different amounts of torsion force.

10. The missile of claim 5, wherein the bushing includes a seat to prevent rotation of the shaft beyond a deployed position.

11. The missile of claim 10, wherein the bushing includes a keyway that is configured to engage a key on the shaft after the shaft reaches the deployed position.

12. The missile of claim 11, wherein the spring provides force to urge engagement of the key of the shaft and the keyway of the bushing.

13. The missile of claim 12, wherein the spring is a coil spring extending around the shaft.

14. The missile of claim 13, wherein the coil spring includes plural coils, none of which are in contact with each other.

15. The missile of claim 1, further comprising a retaining mechanism to retain the spring in the deployed position.

16. The missile of claim 15, wherein the retaining mechanism includes a key on the shaft that engages a keyway of a bushing that is around the shaft.

17. The missile of claim 15, wherein the retaining mechanism includes a spring-loaded pin that is coupled to the body, and that engages a recess in the shaft.

18. The missile of claim 1, wherein the foil is substantially planar, and wherein the axis of the shaft is fixed at an acute angle relative to a longitudinal axis of the foil.

19. The missile of claim 1, wherein the foil is external to the missile body when the fin is in a stowed position.

20. A missile comprising:

a missile body;

a deployable fin having a shaft inserted into a cavity in the missile body;

a torsion spring coupled to the shaft, wherein the spring is configured such that torsion from the spring rotates the fin about an axis of the shaft, thereby deploying the fin; and a retaining mechanism to retain the spring in the deployed position;

wherein the retaining mechanism includes:

a spring-loaded pin that is coupled to the body, and that engages a recess in the shaft; and a release lever for disengaging the pin from the recess; and wherein the missile body includes an access hole for receiving a push rod to depress the lever.

* * * * *

UNITED STATES PATENT AND TRADEMARK OFFICE

CERTIFICATE OF CORRECTION

PATENT NO. : 7,642,492 B2
APPLICATION NO. : 11/043870
DATED : January 5, 2010
INVENTOR(S) : Parine et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 924 days.

Signed and Sealed this

Sixteenth Day of November, 2010

David J. Kappos

David J. Kappos
*Director of the United States Patent and Trademark Office*